United States Patent [19]

Flanagan et al.

[11] 4,427,466

[45] Jan. 24, 1984

[54] ADVANCED MONOPROPELLANTS

[75] Inventors: Joseph E. Flanagan, Woodland Hills; Edgar R. Wilson, Simi Valley, both of Calif.

[73] Assignee: Rockwell International Corporation, El Segundo, Calif.

[21] Appl. No.: 397,327

[22] Filed: Jul. 12, 1982

[51] Int. Cl.[3] ..... C06B 25/34

[52] U.S. Cl. ..... 149/92; 149/88; 149/109.2

[58] Field of Search ..... 149/92, 88, 109.2

[56] References Cited

U.S. PATENT DOCUMENTS

| | | | |
|---|---|---|---|
| 3,429,917 | 2/1969 | Frankel et al. | 149/92 X |
| 3,873,579 | 3/1975 | Rosher | 149/92 |
| 3,883,377 | 5/1975 | Wright | 149/88 |
| 4,085,123 | 4/1978 | Flanagan | 149/92 |
| 4,141,910 | 2/1979 | Flanagan | 149/88 |

*Primary Examiner*—Stephen J. Lechert, Jr.

*Attorney, Agent, or Firm*—H. Fredrick Hamann; Harry B. Field

[57] ABSTRACT

A liquid monopropellant comprising a mixture of a 1-nitroxy-3-nitrazaalkane oxidizer such as 1-nitroxy-3-nitrazapentane (NNPE) or 1-nitroxy-3-nitrazabutane and mixtures thereof; an energetic azido fuel such as azido alcohols represented by 1-azidoethanol, 1,3-diazidopropanol; azidonitramines represented by 1-azido-3-nitrazapentane, and 1,5-diazido-3-nitrazapentane and mixtures thereof; and a diluent such as methanol and ethylene glycol and mixtures thereof.

9 Claims, No Drawings

ADVANCED MONOPROPELLANTS

BACKGROUND OF THE INVENTION

1. Field of the Invention

This invention relates to propellants and, more specifically, to a series of advanced liquid compositions for monopropellant application.

2. Description of the Prior Art

Liquid propellants include all of the various fluids used to generate energy. These fluids may be a mixture of an oxidizer and a combustible or a single compound. They include but are not limited to oxidizers, fuels, catalysts, inert additives, and compounds.

To be practical, a liquid monopropellant must be chemically and ballistically stable while concurrently capable of generating hot combustion gases when pressurized, heated or fed through a catalyst.

There is an extensive variety of liquid monopropellants which have been tested over the past two decades. However, it has been impossible to find one which provides the ideal stability, performance and low toxicity.

Hydrazine and aqueous hydrazine solutions are representative of presently available monopropellants. Although they have been utilized for monopropellant applications for the past two decades, concerns about the toxicity and carcinogenic nature of the hydrazine have limited the use of these systems. Additionally, hydrazine systems are decomposed by passing the liquid over an expensive metallic catalyst which must be replaced periodically. It is these kinds of problems which the present invention overcomes.

SUMMARY OF THE INVENTION

Accordingly, there is provided by the present invention a new family of liquid monopropellants. These monopropellants comprise an intimate admixture of a 1-nitroxy-3-nitrazaalkane oxidizer, an energetic azido fuel such as an azido alcohol or an azidonitramine and a diluent such as methanol or ethylene glycol.

OBJECTS OF THE INVENTION

Therefore, it is an object of this invention to provide a new family of liquid monopropellant mixtures which can be substituted for hydrazene systems without a loss in the overall system performance.

Another object of the present invention is to provide a monopropellant having a greatly reduced toxicity level.

Still a further object of the present invention is to provide a chemically and ballistically stable monopropellant.

Yet a further object of the present invention is to provide a monopropellant which is relatively simple and inexpensive to decompose.

Other objects, advantages and novel features of the present invention will become apparent from the following detailed description of the invention.

DESCRIPTION OF THE PREFERRED EMBODIMENT

In accordance with the present invention, there is provided a family of new liquid monopropellants which comprise an oxidizer, an energetic azido fuel, and a diluent. Basically, this family of mono-propellants comprises a mixture of a 1-nitroxy-3-nitrazaalkane oxidizer such as 1-nitroxy-3-nitrazapentane (NNPE) or 1-nitroxy-3-nitrazabutane and mixtures thereof; an energetic azido fuel such as azido alcohols represented by 1-azidoethanol, 1,3-diazidopropanol; azidonitramines represented by 1-azido-3-nitrazapentane, and 1,5-diazido-3-nitrazapentane and mixtures thereof; and a diluent such as methanol and ethylene glycol and mixtures thereof.

The 1-nitroxy-3-nitrazaalkane oxidizer has the general structured formula of

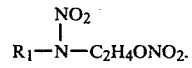

Preferably, $R_1$ is a lower alkyl such as $—CH_3$ or the more preferred $—C_2H_5$. These oxidizers are delineated as 1-nitroxy-3-nitrazabutane and 1-nitroxy-3-nitrazapentane, respectively.

Preparation of these oxidizers can be effected by nitrating the standard alkylalkonolamine according to the method taught by W. J. Chute et al, Canada Journal of Research #26, Section B, Page 114 (1948).

The energetic azido fuels can be chosen from azido alcohols having the general formula

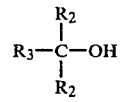

wherein when $R_2$ is H; $R_3$ is $—CH_2N_3$; and when $R_2$ is $—CH_2N_3$, $R_3$ is H; or azidonitramines having the general formula

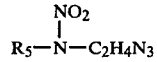

wherein $R_5$ is $—C_2H_5$ or $—C_2H_4N_3$.

Specifically, the preferred azido alcohols are

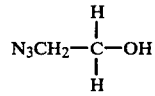

and

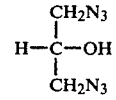

and are delineated as 1-azidoethanol (TAE) and 1-3-diazidopropanol (DAZP), respectively. The preferred azido nitramines are

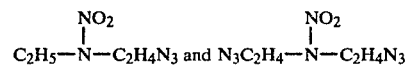

and are delineated as 1-azido-3-nitrazapentane (AZNPE) and 1,5-diazido-3-nitrazapentane (DANPE). The preparation of azidonitramines is specifically delineated in U.S. patent application Ser. No. 270,453 filed June 4, 1981, and in U.S. Pat. Nos. 3,873,579 to Rosher and 4,085,123 to Flanagan et al.

The oxidizer possesses excess oxygen (O/C>1) to burn the carbon present in the oxidizer and energetic azido fuel. The energetic azido fuels serve to increase the overall enthalpy of the system by the presence of the highly exothermic azido moieties, thereby producing large quantities of nitrogen gas.

Finally, the preferred diluent methanol, or ethylene glycol or mixtures thereof are added to reduce the freezing point of the mixture, tailor the flame temperature, and desensitize the mixture.

Table I is a summary of the theoretical performance of selected monopropellant mixtures.

TABLE I

| Wt. Percent | | | | | | | |
|---|---|---|---|---|---|---|---|
| NNPE | TAE | DAZP | AZNPE | DANPE | $CH_3OH$ | $T_f$(°K.) | C* (ft/sec) |
| 63 | 27 | — | — | — | 10 | 1327 | 4123 |
| 56 | 24 | — | — | — | 20 | 1228 | 3991 |
| 49 | 21 | — | — | — | 30 | 1165 | 3872 |
| 65 | 20 | — | — | — | 15 | 1274 | 4063 |
| 60 | — | 20 | — | — | 20 | 1263 | 4039 |
| 45 | — | 15 | — | — | 40 | 1130 | 3791 |
| 63 | — | — | 27 | — | 10 | 1395 | 4231 |
| 56 | — | — | 24 | — | 20 | 1262 | 4072 |
| 49 | — | — | 21 | — | 30 | 1188 | 3945 |
| 52 | — | — | — | 28 | 20 | 1320 | 4143 |
| 39 | — | — | — | 21 | 40 | 1151 | 3858 |
| 70 | — | — | — | 10 | 20 | 1276 | 4062 |
| 50 | — | — | — | 30 | 20 | 1208 | 3979 |

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A liquid monopropellant comprising a 1-nitroxy-3-nitrazaalkane oxidizer, an energetic azido fuel, and a diluent.

2. The liquid monopropellant of claim 1 wherein said 1-nitroxy-3-nitrazaalkane is selected from the group consisting of 1-nitroxy-3-nitrazabutane and 1-nitroxy-3-nitrazapentane, and mixtures thereof.

3. The liquid monopropellant of claim 2 wherein said 1-nitroxy-3-nitrazaalkane is 1-nitroxy-3-nitrazapentane.

4. The liquid monopropellant of claim 1 wherein said energetic azido fuels are selected from the group consisting of azido alcohols and azido nitramines, and mixtures thereof.

5. The liquid monopropellant of claim 4 wherein said azido alcohols are selected from the group consisting of 1-azidoethanol, 1,3-diazidopropanol and mixtures thereof.

6. The liquid monopropellant of claim 4 wherein said azidonitramines are selected from the group consisting of 1-azido-3-nitrazapentane, 1,5-diazido-3-nitrazapentane and mixtures thereof.

7. The liquid monopropellant of claim 1 wherein said diluent is selected from the group consisting of methanol and ethylene glycol, and mixtures thereof.

8. The liquid monopropellant of claim 5 wherein said diluent is methanol.

9. The liquid monopropellant of claim 1 comprising from about 30 to about 80 weight percent oxidizer, about 10 to about 30 weight percent energetic azido fuel, and from about 10 to about 40 weight percent diluent.

* * * * *